US005277242A

United States Patent [19]

Arrington

[11] Patent Number: 5,277,242

[45] Date of Patent: Jan. 11, 1994

[54] PIPE CASTING MACHINE HAVING IMPROVED PIPE MOLD STABLING RINGS

[75] Inventor: Merrill D. Arrington, Birmingham, Ala.

[73] Assignee: American Cast Iron Pipe Co., Birmingham, Ala.

[21] Appl. No.: 956,174

[22] Filed: Oct. 5, 1992

[51] Int. Cl.[5] ..... B22D 13/02

[52] U.S. Cl. ..... 164/298; 138/113; 164/291; 165/88

[58] Field of Search ..... 164/291, 298, 299, 300, 164/301; 277/169; 138/108, 113, 114; 165/88

[56] References Cited

U.S. PATENT DOCUMENTS

| | | | |
|---|---|---|---|
| 1,573,089 | 2/1926 | Rice | 164/291 |
| 3,651,859 | 3/1972 | Wahl et al. | 164/298 X |
| 3,796,253 | 3/1974 | Lorang | 164/298 X |

FOREIGN PATENT DOCUMENTS

| | | | |
|---|---|---|---|
| 557582 | 6/1957 | Belgium | 164/298 |
| 627240 | 9/1927 | France | 164/301 |
| 1222405 | 4/1986 | U.S.S.R. | 164/298 |

*Primary Examiner*—J. Reed Batten, Jr.

*Attorney, Agent, or Firm*—Kerkam, Stowell, Kondracki & Clarke

[57] ABSTRACT

A stabilizing ring assembly for stabilizing a mold in a centrifugal pipe casting machine during operation includes a plurality of ring segments mounted on the mold and cooperating to form an annular ring retained in the mold by a plurality of resilient O-rings positioned in grooves extending around the annular ring with the O-rings fitting within and being compressed radially by the casting machine housing surrounding and rotating with the mold, and water flow passages are formed in the ring segments to permit the flow of cooling water axially of the casting machine between the internal surface of the housing and the external surface of the mold.

7 Claims, 3 Drawing Sheets

PIPE CASTING MACHINE HAVING IMPROVED PIPE MOLD STABLING RINGS

BACKGROUND OF THE INVENTION

1. Field of the Invention

This invention relates to pipe casting machines for centrifugally casting metal pipe, and more particularly to such pipe casting machines having improved intermediate mold support means for centering and supporting the pipe mold in the casting machine for rotation about its longitudinal axis.

2. Description of the Prior Art

Pipe casting machines for centrifugally casting metal pipe, typically from cast iron, are well known and widely used commercially. In such pipe casting machines, a measured amount of molten metal is poured into an elongated generally cylindrical metal mold progressively from one end thereof to the other while the mold is being rotated about its longitudinal axis at a rate to evenly distribute and retain the molten metal over the interior wall of the mold. During pouring of the molten iron and for a predetermined time thereafter, the external wall of the mold is cooled to prevent damage to the mold and to extract heat of fusion from the molten metal. This cooling is accomplished either by directing a spray or multiple streams of water onto the external surface of the mold or by submerging the mold in a cooling water bath. In either case, the mold must be cooled uniformly to avoid damage to the pipe being cast and to prevent excessive distortion of the mold.

The high speed rotation required of a centrifugal casting mold makes it necessary that any eccentric loading resulting from mold bending or being out of round be maintained at a minimum since any eccentric loading not only places uneven stresses on the equipment but also tends to produce uneven metal thickness in the pipe being cast. Any eccentric loading produced by uneven distribution of the molten metal being cast can also result in mold distortion which may further aggravate the problem. This is particularly true for relatively long molds used to cast smaller diameter pipe since the relatively slender lightweight mold structure has less rigidity in bending.

In one centrifugal pipe casting machine manufactured by Pont-a-Mousson S.A., intermediate mold stabilizing rings are provided between the external surface of the pipe mold and the rotating cylindrical casting machine having a sleeve surrounding the mold. In this machine, cooling water flows into the annular space between the rotating housing and the pipe mold mounted concentrically therein through an inlet at one end of the housing, then along the length of the mold between the mold and the housing to an exit at the opposite end of the assembly. The intermediate stabilizing or centering ring assemblies each consist of two substantially semicircular ring halves having a radial tongue on their inner diameter which fits into an annular groove in the outside diameter of the pipe mold. The outside diameter of the ring halves have a machined recess that is hardened and serves as a seat for an endless coil or garter spring which holds the split ring firmly against the mold. The outside diameter of the garter spring is sized to have a close tolerance fit within the inside diameter of the rotating housing structure and the cooling water flowing through the chamber between the mold and housing can flow over the split ring through the open coils of the spring. When a smaller diameter pipe is being cast, the ring halves may have radially inwardly extending flanges with axial bores formed therein to provide additional water flow passage. The split ring centering assemblies provide a radial load carrying support for transferring loads between the outside diameter of the mold and the larger diameter rotating sleeve or housing assembly to stabilize the rotating mold.

In the known split ring intermediate mold support design discussed above, the close tolerance fits required between the pipe mold and the split ring, the split ring and coil spring, and between the coil spring and the rotating sleeve are difficult to achieve and to maintain. Unavoidable movement of the spring relative to the split ring OD and to the rotating sleeve causes wear on the contact surfaces and when the wear becomes excessive, the mold may vibrate and/or run eccentric with respect to the axis of rotation of the assembly. This, in turn, can result in scrap pipe, and the sleeve or rings may have to be replaced. Further, wear and problems in maintaining the proper fit causes difficulty in assembly and disassembly of the pipe mold and the rotating sleeve. Accordingly, it is a primary object of the present invention to provide a centrifugal pipe casting machine having improved mold stabilizing means disposed between the mold and the casting machine housing.

Another object is to provide a centrifugal pipe casting machine with an improved split ring mold stabilizing assembly having greater dimensional tolerances and which does not require hardening the external surface of the split ring to reduce wear during use.

Another object is to provide such a pipe casting machine employing split ring type intermediate mold stabilizing assemblies which are more economical to produce, which facilitate assembly and disassembly of the pipe mold and rotating sleeve, and which require less maintenance during use.

Another object of the invention is to provide such an improved split ring intermediate stabilizing assembly which reduces mold vibration and increases stability and which provides a longer life than the known intermediate mold stabilizing assemblies.

SUMMARY OF THE INVENTION

In the attainment of the foregoing and other objects and advantages, an important feature of the invention resides in providing a split ring structure which contacts the outer diameter of the mold and is retained thereon by a plurality of elastomeric O-rings disposed within grooves extending around the periphery of the split ring assembly. The O-rings are dimensioned to provide an interference fit with the cylindrical inner surface of the rotating sleeve assembly and to provide sufficient resistance to compression to provide a continuous vibration dampening, stabilizing force around the rotating mold. Water flow past the individual split ring assemblies is provided either by axial bores in the split ring metal segments or through axially extending grooves formed in the inner periphery of the split ring segments to thereby provide improved heat transfer between the cooling water and the outer surface of the mold in the vicinity of the split ring stabilizing assemblies.

BRIEF DESCRIPTION OF THE DRAWINGS

The foregoing and other features and advantages of the invention will be apparent from the detailed description contained hereinbelow, taken in conjunction with the drawings, in which.

DESCRIPTION OF THE PREFERRED EMBODIMENTS

Figure 1:
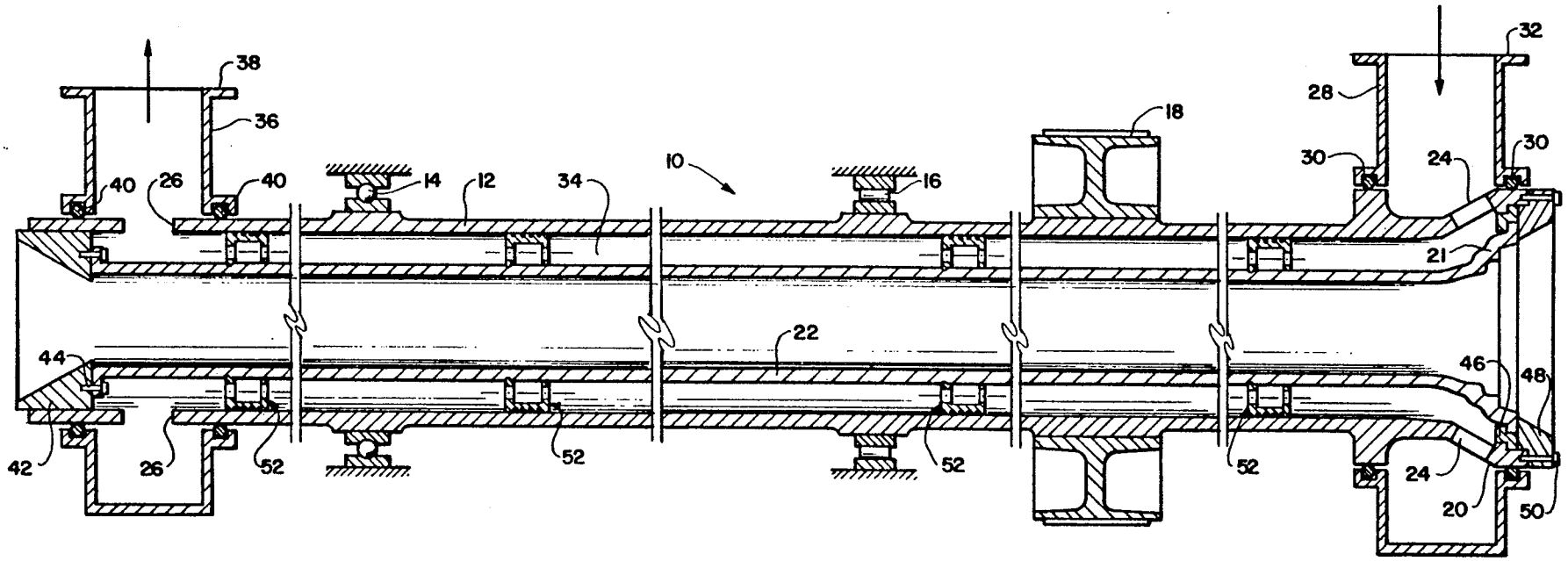
FIG. 1 is an elevation view, in section, showing a centrifugal pipe casting machine embodying the present invention.

Referring now to the drawings in detail, a centrifugal pipe casting machine embodying the present invention is schematically illustrated in FIG. 1 and designated generally by the reference numeral 10. The machine 10 comprises an elongated hollow generally cylindrical housing or sleeve 12 supported for rotation about a generally horizontal axis by spaced anti-friction bearings such as the ball bearing 14 and roller bearing 16. The roller bearing 16 preferably is designed to accommodate thermal expansion of the sleeve and both bearings may incorporate spherical seating means, not shown, to accommodate minor misalignments or flexure during operation. A drive gear 18 is mounted on the housing 12, by a suitable means such as keyways and locking set screws, not shown, for driving the housing in rotation about its longitudinal axis. Drive means such as a drive gear and motor, also not shown, engage the gear 18 to drive the assembly at the desired rate of rotation.

Housing 12 has an enlarged generally cone shaped section 20 at one end for receiving the bell end 21 of an elongated, hollow generally cylindrical pipe mold 22. A plurality of cooling water inlet openings 24 are provided in the enlarged end portion 20 and a plurality of cooling water outlet openings 26 are formed in the housing 12 adjacent its opposite end. A stationary inlet water manifold 28 extends around the housing 12 adjacent the enlarged cone shaped end, and resilient sealing means illustrated schematically by the O-ring seals 30 provide a fluid seal while enabling the housing to rotate in the manifold. A flanged inlet coupling 32 is provided on manifold 28 for connection to a water supply line, not shown, to supply cooling water through the inlet openings 24 to the concentric cooling water chamber 34 between the inner surface of housing 12 and the outer surface of mold 22. Cooling water entering space 34 through inlet openings 26 flows through the outlet openings 26 in housing 12 into a stationary outlet manifold 36 having its flanged outlet 38 connected to a suitable drain pipe, not shown. Suitable sealing means illustrated schematically by the O-ring seals 40 are also provided between the outer surface of housing 12 and the stationary outlet manifold 36.

The cooling water chamber 34 is closed adjacent the outlet end of the housing by a spacer ring 42 which is mounted, as by bolts 44 on the end of the mold 22 and contacts the inner surface of body 12. In practice, a suitable seal is provided between the spacer ring 42 and the inner surface of housing 12 to prevent the escape of cooling water. The opposite end of chamber 34 is sealed by a spacer ring 46 positioned at the end of the cone shaped portion 20, with spacer 46 engaging a flange on the bell end of mold 22 to accurately align and support the bell end of the mold in the housing. Once the mold is installed in the sleeve, a mounting ring 48 is secured, as by bolts 50, onto the end of the housing 12 to rigidly retain the mold and housing in coaxial relation and to provide a water-tight joint therebetween.

Figure 4:
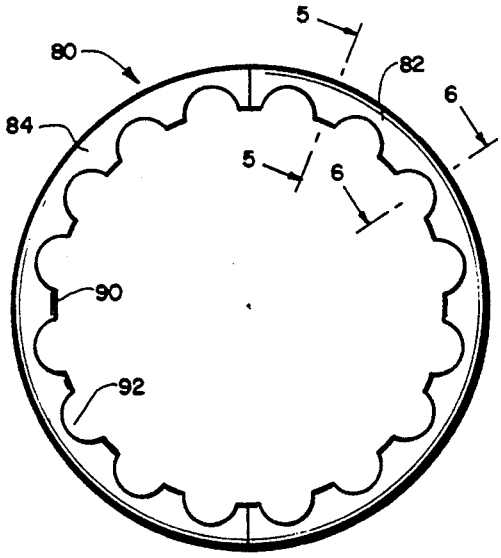
FIG. 4 is a view similar to FIG. 3 showing an alternate embodiment of the intermediate support ring assembly.
Figure 5:
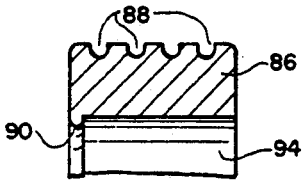
FIG. 5 is a sectional view taken on line 5—5 of FIG. 4.
Figure 6:
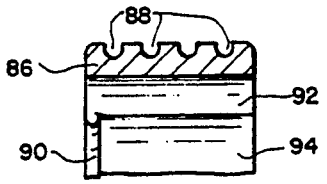
FIG. 6 is a sectional view taken on line 6—6 of FIG. 4.
Figure 7:
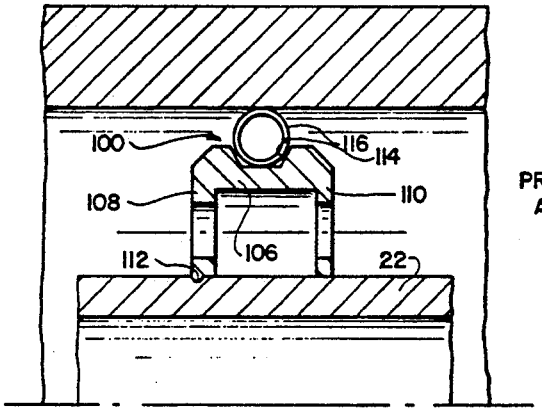
FIG. 7 is a view similar to FIG. 3 showing a prior art intermediate support ring assembly.
Figure 9:
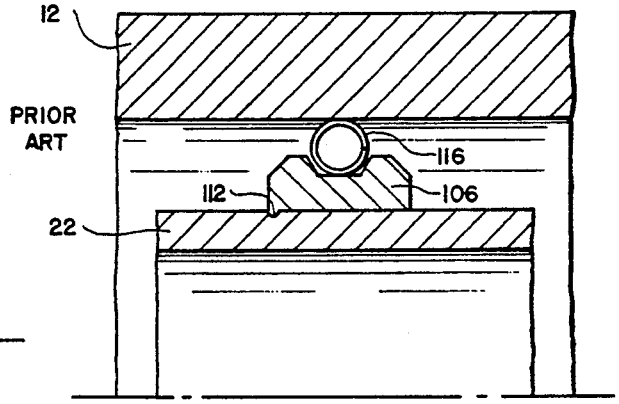
FIG. 9 is a view similar to FIG. 7 and showing another prior art intermediate support ring assembly.
Figure 8:
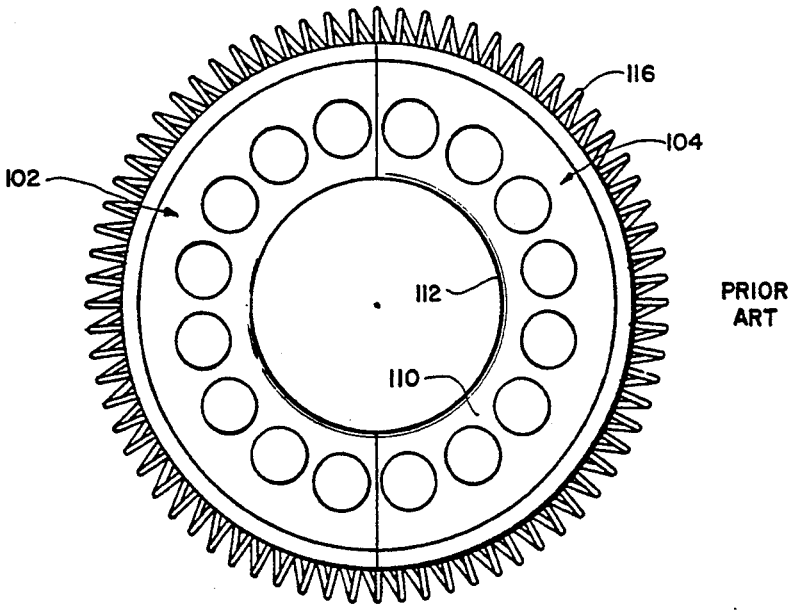
FIG. 8 is a end elevation view of the intermediate support ring assembly shown in FIG. 5.

A plurality of mold centering and stabilizing ring assemblies 52 are mounted on the external surface of mold 22, at spaced intervals therealong, to radially support and stabilize the mold during rotation by transferring limited radial loads to the housing 12. The stabilizing ring assemblies 52 are more clearly seen from the enlarged drawings in FIGS. 2 and 3, while an alternate embodiment of the stabilizing ring assembly is illustrated in FIGS. 4–6. Prior art stabilizing ring assemblies of the type referred to hereinabove are illustrated in FIGS. 7–9.

Figure 2:
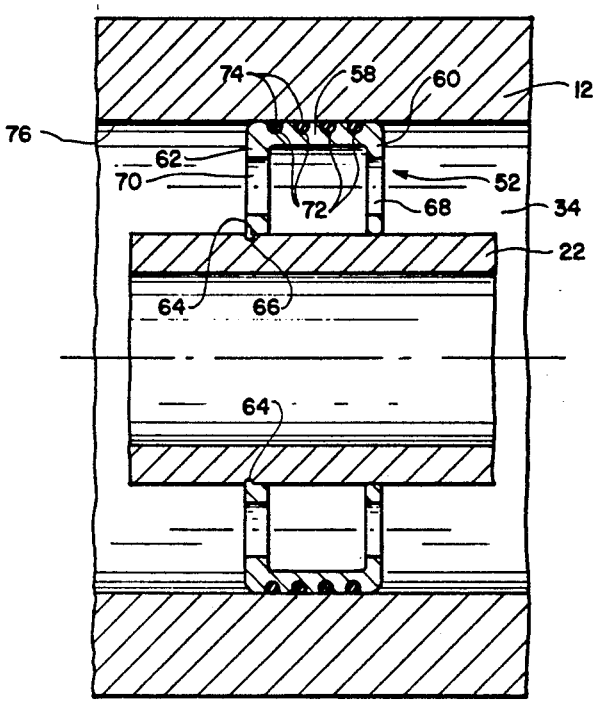
FIG. 2 is an enlarged fragmentary view of a portion of the structure shown in FIG. 1 and illustrating one intermediate support ring assembly.
Figure 3:
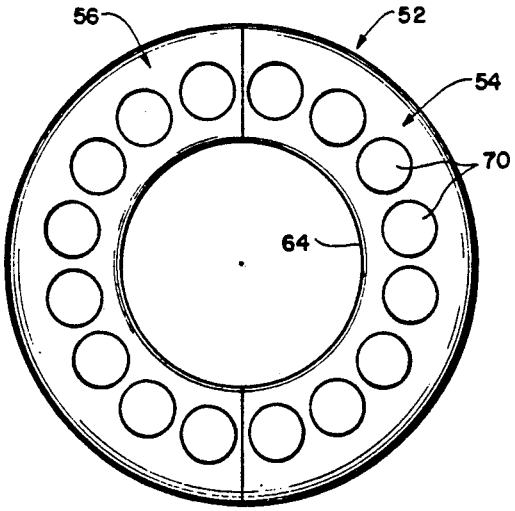
FIG. 3 is an end elevation view of the intermediate support ring assembly shown in FIG. 2.

Referring now to FIGS. 1–3, it is seen that the mold stabilizing assemblies 52 each comprise a pair of identical semicircular ring half sections assembled together to form a complete ring encircling the pipe mold 22. Since ring sections 54 and 56 are identical, only section 54 will be described in detail, and as shown in FIG. 2, section 54 is a rigid channel shaped metallic element comprising an axially extending, semicircular body or rim portion 58 having integral, inwardly directed flanges 60, 62 formed one at each end thereof. The inner peripheral edge surface of flanges 60, 62 have a radius of curvature corresponding to the radius of the outer surface of mold 22 so as to fit snugly around and rest upon the mold when the two ring sections are assembled. Flange 60, however, is formed with a radially inwardly extending tongue 64 at one peripheral edge thereof which fits within a complementary annular groove 66 in the outer surface of mold 22 to position the respective stabilizing ring assemblies 52 at the desired locations along the length of the mold. to accomplish this, flange 62 may be thicker than flange 60 to provide an inner peripheral surface resting upon the outer cylindrical surface of the molds 22 to provide a load transmitting bearing surface between the inner periphery of the flange and the outer periphery of the mold. Flange 60 is provided with a plurality of spaced axial bores 68, and flange 62 has a corresponding number of axial bores 70 formed therethrough to provide the path for the flow of cooling water axially along the outer surface of mold 22 through the space 34 past the respective ring assemblies 52.

The outer, semicircular rim portion 58 of ring segment 54 is formed with a plurality of circumferentially extending generally U-shaped grooves 72 in its outer surface, with each groove 72 adapted to receive a resilient O-ring 74 when the ring sections 54, 56 are assembled around the mold 22. The outer surface of the rim portion 58 has a radius of curvature slightly less than the radius of curvature of the inner surface 76 of the cylindrical housing 12, with the radial thickness of the O-rings being such that, when mounted on the ring assemblies 52, their outer diameter is slightly greater than the diameter of the inner surface 76 whereby, when installed in the position shown in FIG. 2, the O-rings 74 are compressed within the grooves 72 by contact with surface 76. In use, at least three and preferably four O-rings will normally be employed on each stabilizing ring assembly to provide the desired load transfer capability over a long period of time.

In use, the stabilizing ring assemblies 52 are mounted on the mold 22 before the mold is inserted into the housing 12. The two ring segments 54, 56 are assembled on the mold, with the tongues 64 fitting within the grooves 66 and the O-rings 74 are telescoped over the end of the mold and mounted one in each U-shaped groove 72. In the relaxed state, the O-rings have a diameter less than that of the rim 58 so that they must be stretched over the rim to be mounted in the grooves, thereby applying a hoop tensile load in the respective O-rings which retains the ring sections 54, 56 on the mold. As shown in FIG. 1, a plurality of ring assemblies are mounted, at spaced intervals along the length of the mold, as necessary, to provide the desired mold stabilizing and vibration dampening effect.

As illustrated in FIG. 1, four stabilizing ring assemblies may be used, and are mounted on the mold prior to insertion of the mold into the housing. Once the ring assemblies are in contact with the cylindrical surface 76, the tongue and groove engagement between the ring segments and the mold prevent axial displacement of the stabilizing assemblies as the mold is telescoped into position within the housing.

The elastomeric material employed to form the O-rings 74 has a density and resilience such that the compressive load applied by the cylindrical surface 76 is sufficient to stabilize the mold during the high speed rotation of the mold and housing to provide the necessary vibration dampening and stabilizing effect on the mold. The resilience of the O-rings maintains continuous contact with the surface 76 throughout the casting operation and maintains a firm contact between the mold and the inner periphery of the ring segments so that metal at these contacting surfaces is substantially eliminated. Further, the composition of the O-rings is such that essentially all wear is eliminated in the rim portion of the ring segments and on the surface 76, making it unnecessary to subject the ring segments to the heat treatment process to harden the surface of the grooves as was required by the prior art arrangement employing the metallic garter spring. Further, when the mold is removed from the housing for service for maintenance, the O-rings may be replaced, if necessary, at relatively little expense and, since the use of the resilient O-rings results in essentially eliminating wear on the ring structure, the life of the stabilizing ring segments are greatly increased and require essentially no maintenance.

Referring now to FIGS. 4–6, an alternate embodiment of the invention is indicated generally by the reference numeral 80 and comprises two identical semicircular spacer ring segments 82, 84 arranged to define the complete annular spacer ring in a manner similar to that described above. Ring segments 82, 84 have a radial dimension substantially less than ring segments 52, 54, 56, however, and are particularly useful in casting of pipe in a mold assembly having a larger diameter which substantially reduces the volume of the cooling water channel 34.

Ring segments 82, 84 have a solid body or rim portion 86 having an outside radius of curvature slightly less than that of the inside surface 76 of housing 12, and has a plurality of generally U-shaped annular grooves 88 formed in its outer surface in a manner similar to that described above. Also, an inwardly directed tongue 90 is formed adjacent one side edge of each rim portion 86 around its inner periphery, and a plurality of axially extending arcuate grooves 92 are formed in the inner surface of each ring segment, with the grooves extending through the tongue 90 to provide a gear-tooth-like inner peripheral surface on the ring segments. This presents a series of lands 94 on the inner ring surface, with the lands being dimensioned to contact the outer surface of the mold 22 when the spacer ring assembly is mounted on the mold. Also, the inwardly directed tongue 90 is segmented, with the tongue segments adapted to fit within a complementary groove such as the groove 66 described above to axially fix the assembly on the pipe mold. Resilient O-ring members are used in the arcuate grooves 88 as described above to hold the ring segments 82, 84 in assembled relation on the mold. The arcuate grooves 92 provide axial channels for the cooling water to flow past the respective stabilizing ring assemblies, with the cooling water flowing in direct contact with the outer surface of the pipe mold around a major portion of its circumference at each stabilizing ring assembly. In this regard, the dimension of the lands 94, around the periphery of the pipe mold, is substantially less, and preferably no more than about ½ the corresponding dimension of the arcuate water flow channels. Since the outer peripheral surface of the rim portion 86 may have a radius of curvature substantially equal to that of the inner surface 76 of the body 12, and since the resilient O-ring members 74 used in the invention may have a diameter substantially less than that of the conventional garter spring used in the prior art, the radial thickness of rim portion 86 whereby grooves 92 may be of sufficient size to provide adequate capacity for the cooling water flowing axially through channel 34 to continuously cool the external surface of the mold 22.

Referring to FIGS. 7, 8 and 9, the prior art stabilizing ring assemblies described hereinabove are illustrated. FIGS. 7 and 8 show a stabilizing ring assembly employed for stabilizing a mold for the production of relatively small diameter pipe, and employs a ring assembly 100 comprising a pair of semicircular ring segments 102, 104, each having rim portion 106 and a pair of spaced, inwardly extending flanges 108, 110, with flange 110 having a tongue 112 for cooperating with the annular groove in the mold 22 as described above. Bores extending through flanges 108, 110 may be provided to facilitate the flow of water in this embodiment. The rim portion 106 is formed with a single circumferential channel 114 in its outer surface for receiving and supporting an endless garter spring 116. As is known, in this prior art assembly, the rim portion 106 must be hardened in order to resist wear by contact with the metallic spring during use. Also, the metal-to-metal contact between the garter spring 116 and the inner surface of the body 12 quickly results in wear in the body. Even when a new garter spring and support ring assembly are employed, relative movement and wear will be experienced during operation. The heat treatment required to harden the surface of the support ring to resist such wear greatly increases the cost of the structure.

In FIG. 9, the prior art structure employed for forming larger diameter pipe within the cylindrical body 12 is shown. In this embodiment, as in the structure shown in FIGS. 4–6, the flanges are eliminated and it is seen that all cooling water must flow through the openings in the coil spring. In view of the axial dimension of the garter spring support rim, inadequate cooling and a resultant hot spot in the pipe being formed may result. The dimensions of the coil spring required to adequately support the stabilizing rings makes the use of cooling channels as described with reference to FIGS. 4–6 impractical when pipe approaching the maximum permissible diameter is being formed in the apparatus.

While preferred embodiments of the invention have been disclosed and described, it should be apparent that the invention is not so limited and it is therefore intended to include all embodiments thereof which would be apparent to one skilled in the art and which come within the spirit and scope of the invention.

What is claimed is:

1. A stabilizing ring assembly for stabilizing an elongated pipe casting mold supported within an elongated housing for coaxial rotation therewith in a centrifugal pipe casting machine during operation thereof comprising, a plurality of ring segments adapted to be mounted on the external surface of the mold, said ring segments cooperating to define an annular ring around the mold, a plurality of spaced grooves formed in and extending around the outer periphery of the annular ring, a plurality of resilient elastomeric O-rings located one in each said groove and applying a radial force thereto retaining said ring segments in contact with said mold, said O-rings being dimensioned to contact and be radially compressed by the internal surface of the pipe casting machine to transmit limited radial load from the mold to the housing, and water flow channel means formed in said ring segments to permit the flow of cooling water axially of the casting machine between the mold and the housing past said stabilizing ring assembly.

2. The stabilizing ring assembly defined in claim 1 wherein said ring segments comprise a pair of semicircular ring segments, said ring segments each having a radially inwardly extending tongue adapted to be received within a complementary groove in the external surface of the mold to axially locate the ring assembly on the mold.

3. The stabilizing ring assembly defined in claim 2 comprising at least three annular grooves extending around the outer periphery of the annular ring.

4. The stabilizing ring assembly defined in claim 3 wherein said water flow channel means comprise a plurality of axially extending generally U-shaped channels formed on the radial inner surface of each said ring segment to permit water flow past the stabilizing ring assembly in contact with the outer surface of the mold.

5. In a mold stabilizing ring assembly for use in a centrifugal pipe casting machine of the type including an elongated generally cylindrical metal pipe mold mounted coaxially within an elongated generally cylindrical metal housing for rotation therewith about a common longitudinal axis with an annular cooling water channel extending therebetween and at least one mold stabilizing ring assembly mounted on the external surface of the mold intermediate its ends and contacting the internal surface of the housing for transferring limited radial loads from the mold to the housing during operation, the ring assembly including a plurality of ring segments mounted on and cooperating to define an annular ring surrounding the mold and endless resilient band means extending around and maintaining said ring segments in contact with the outer surface of the mold, said resilient band means having a radial thickness to contact the internal surface of the housing to transfer loads between the mold and housing, the improvement wherein said ring segments each have a plurality of circumferentially extending grooves formed in their outer surface cooperating to define a plurality of annular grooves around said ring and wherein said resilient means comprises an elastomeric O-ring mounted one in each said annular groove, said O-rings having a radial thickness greater than the distance between the bottom of said groove and said internal surface of said housing and being compressed therebetween to maintain a continuous radial load between the housing and said mold through said ring segments, and axially extending water flow channel means formed through each said ring segment to permit the flow of cooling water axially of said housing and mold through said mold stabilizing ring assembly.

6. The stabilizing ring assembly defined in claim 5 wherein said ring assembly comprises at least four annular grooves formed in said annular ring.

7. The stabilizing ring assembly defined in claim 6 wherein said water flow channel means comprise a plurality of axially extending generally U-shaped channels formed on the radial inner surface of each said ring segment to permit water flow past the stabilizing ring assembly in contact with the outer surface of the mold.

* * * * *